US005350008A

United States Patent [19]

Liu et al.

[11] Patent Number: 5,350,008

[45] Date of Patent: Sep. 27, 1994

[54] MOLD ASSEMBLY FOR THERMO-MOLD CONTINUOUS CASTING

[75] Inventors: Jia-Chin Liu; Shu-Fahr Chang; Shyue-Sheng Wu; Yen-Cheng Cheng, all of Hsinchu, Taiwan

[73] Assignees: Industrial Tech. Research Institute, Hsinchu, Taiwan; OCC Research Center Inc., Tokyo, Japan

[21] Appl. No.: 100,910

[22] Filed: Jul. 30, 1993

[51] Int. Cl.[5] ..... B22D 11/00

[52] U.S. Cl. ..... 164/440; 164/490

[58] Field of Search ..... 164/440, 490

[56] References Cited

FOREIGN PATENT DOCUMENTS 55-46265 11/1980 Japan .

63-52753 3/1988 Japan .

*Primary Examiner*—Kuang Y. Lin

*Attorney, Agent, or Firm*—Lackenbach Siegel Marzullo Aronson & Greenspan

[57] ABSTRACT

A mold assembly for a thermo-mold continuous casting apparatus which has a casting furnace and a thermo-mold chamber provided with an outlet. The assembly has a first mold member changeably or replaceably mounted within the thermo-mold chamber and being provided with a casting cavity and an enlarged cavity therein. A second mold member is mounted within the thermo-mold chamber and connected to the first mold member. The second mold member is provided with a cavity channel therein communicating with the enlarged cavity of the first mold member, and separating means in the cavity channel for separating the residual metal in the first and second mold members when the casting procedure in the thermo-mold continuous casting apparatus is stopped. An air inlet may be arranged on the thermo-mold chamber to introduce a protective air into the thermo-mold chamber upon changing the first mold member.

10 Claims, 4 Drawing Sheets

MOLD ASSEMBLY FOR THERMO-MOLD CONTINUOUS CASTING

BACKGROUND OF THE INVENTION

The present invention relates generally to a mold changing system for a thermo-mold continuous casting, which can significantly reduce the mold changing time and thus increase the yield. The system also can facilitate the production of a metal casting having a unidirectional solidified structure and an excellent surface quality.

By conventional continuous casting methods, the casting has a polycrystalline structure, a rough surface, and sometimes local surface cracks. These defects have to be removed before the post process such as the wire drawing or rolling process, generally by a paring method. If the cracks are too deep, however, they will be unable to be removed, and even cannot be machined. In such a situation, the amount of rejected products is thus increased. In order to alleviate these defects, the Japanese Patent Publication No. 55-46265 proposed an operation of continuous casting (OCC) by using a heating mold. In this operation, a graphite mold is heated by a heater surrounding the graphite mold to maintain its inner temperature above the melting point of the cast metal. The mold is supplied with a molten metal from one end thereof. The cast piece is drawn from the other end of the mold by a draw bar, and then is cooled directly by water. The formed cast piece is thus in the form of columnar crystal or single crystal grown along the axial direction thereof. The mold, typically, must have the following properties of being: 1. heat-resistant; 2. declined to react with the metal liquid, and dampproof; 3. heat impact-resistant; and 4. good heat conductivity. In casting copper or aluminum, the graphite is a very excellent mold material because it has all properties described above and a low cost, and can easily be machined. The surface of the graphite mold, however, easily suffers from oxidization at a high temperature, i.e. over 400° C. This will affect the surface quality of the cast piece, and shorten the service life of the mold. When the oxidization of the graphite mold is severe, the graphite mold has to be changed to maintain the quality of the cast piece. The changing of the mold, however, is very time-consuming. For example, in the thermo-mold continuous casting apparatus disclosed in the Japanese Patent Publication No. 63-52753, the crucible of the casting furnace is connected to the heated mold at one side thereof. When it is desired change the mold, the changing task can be performed only after the casting furnace and heating mold are cooled to the room temperature because the mold cavity still has a residual metal.

Referring to FIGS. 1, 2 and 3, FIG. 1 shows a flow chart of conventional mold changing procedure, FIG. 2 shows a conventional thermo-mold continuous casting apparatus, and FIG. 3 shows a thermo-mold assembly used in the thermo-mold continuous casting apparatus. For a clear understanding, the conventional thermo-mold continuous casting apparatus of FIG. 2 is described briefly here. The apparatus includes a thermo-mold chamber 8, a casting furnace 15, and a heat insulation wall 20 located between the thermo-mold chamber 8 and the casting furnace 15. The casting furnace 15 includes a base 12, a cover 13, a control switch 14, and a casting crucible 30. The casting crucible 30 has a base 18, and a surrounding heater 19. The material bar 17 can be fed into the casting crucible 30 through a feeding wheel pair 16. The thermo-mold chamber 8 includes a front surrounding heater 4, a rear surrounding heater 5, a mold supporting frame 6, a chamber cover 7, an outer wall 9, and a bracket 11. In the thermo-mold chamber 8, a mold assembly consisted of a front mold 1, a middle mold 2 and a rear mold 3 is mounted.

The general reason to change the mold is that the inner wall of the front mold 1 has been oxidized, or that the molten metal broke out and then blocked the outlet 31 of the front mold 1. In either situation, although it seems that only the front mold 1 needs to be changed, this is not practical :fin the conventional system. In the conventional mold assembly, the inner channels of front, middle, and rear molds 1, 2, and 3 directly connect together. Thus, when the control switch 14 is turned off to close the flow channel, and front and rear heaters 4 and 5 in chamber 8 are also turned off, the residual molten metal in the inner channels of front, middle, and rear molds 1, 2, and 3 will become getting solidified as a continuous bar or rod 22, as shown in FIG. 3. In such a situation, merely changing front mold 1 is not possible, that is to say that the entire mold assembly has to be changed altogether. To change the entire mold assembly, heater 19 for casting crucible 30, in addition to heaters 4 and 5 for the mold assembly, has to be turned off also. Then, the casting furnace 15 and the thermo-mold chamber 8 have to be cooled down to near room temperature to facilitate the detachment of the mold supporting frame 6 and the entire mold assembly, and to prevent the casting graphite crucible 30 and the graphite mold from oxidization.

This conventional mold changing procedure is summarized in FIG. 1. Firstly, the power of the casting crucible 30 and heating molds 1, 2, and 3 is shut off for about 12–16 hours, as shown in the block 70, in order to let them be cooled to room temperature, as shown in the block 72. After about 0.5 hour, the mold assembly is detached, and a new mold assembly is installed with realignment, as shown in the block 74. This will take about 2 hours. The casting crucible 30 and new mold assembly will be re-heated for about 2 hours, as shown in the block 76, and then the casting can begin again, as shown in the block 78. It can be clearly appreciated that conventional mold changing procedure is very time-consuming, and wastes very much energy.

SUMMARY OF THE INVENTION

Therefore, the primary object of the present invention is to provide a fast mold changing system for a thermo-mold continuous casting, which can significantly simplify the mold changing procedure, i.e. reduce the mold changing time. In this way, the yield thereof can be thus increased, and the operation cost thereof can be lowered down.

Another object of the present invention is to provide a mold assembly for a thermo mold continuous casting apparatus, which can be partially and easily changed when the thermo-mold chamber of the thermo mold continuous casting apparatus is still at a relative high temperature, e.g. about 400° C. In this way, the cooling and reheating times can be largely reduced because the thermo-mold chamber and the thermo mold need not be cooled to the room temperature.

In accordance with one preferred embodiment of the present invention, a mold assembly for a thermo mold continuous casting apparatus which has a casting furnace and a heated mold chamber provided with an outlet, and is adapted to cast a metal includes a first mold member adapted to be mounted within the thermo-mold chamber and having two ends, one end being adapted to be positioned adjacent to the outlet and provided with a first cavity therein, and the other end being provided with an enlarged cavity therein communicating with the first cavity in the one end; and a second mold member adapted to be mounted within the thermo-mold chamber, connected to the other end of the first mold member, and being provided with a cavity channel therein communicating with the enlarged cavity of the first mold member and separating means in the cavity channel for separating the residual metals in the first and second mold members when the thermo-mold continuous casting apparatus stops casting.

In accordance with one aspect of the present invention, the separating means may be a substantially upright stopper in the cavity channel. The cavity channel of the second mold member has a first portion extending substantially horizontally, a second portion extending upwards from the first portion, and a third portion extending substantially horizontally from the second portion and communicating with the enlarged cavity of the first mold member. The first cavity in the one end of the first mold member extends substantially horizontally.

In accordance with another aspect of the present invention, the mold assembly may further include a third mold member adapted to be mounted within the thermo-mold chamber and connected between the casting furnace and the second mold member. The third mold member is provided with a third cavity communicating with the cavity channel of the second mold member.

In accordance with another preferred embodiment of the present invention, a mold changing system for a thermo mold continuous casting apparatus which has a casting furnace and a thermo-mold chamber provided with an outlet and is adapted to cast a metal includes a first mold member changeably mounted within the thermo-mold chamber and having two ends, one end being positioned adjacent to the outlet and provided with a first cavity therein, and the other end being provided with an enlarged cavity therein communicating with the first cavity in the one end; and a second mold member mounted within the thermo-mold chamber, connected to the other end of the first mold member, and being provided with a cavity channel therein communicating with the enlarged cavity of the first mold member and separating means in the cavity channel for separating the residual metals in the first and second mold members when the thermo-mold continuous casting apparatus stops casting.

In accordance with another aspect of the present invention, the mold changing system may further include an air inlet arranged in the thermo-mold chamber, and adapted to introduce a protective gas into the thermo-mold chamber during the changing of the first mold member. Preferably, the protective gas is an argon gas.

The present invention can be more fully understood by reference to the following description and accompanying drawings, which form an integral part of this application:

DETAILED DESCRIPTION OF THE PREFERRED EMBODIMENTS

Figure 1:
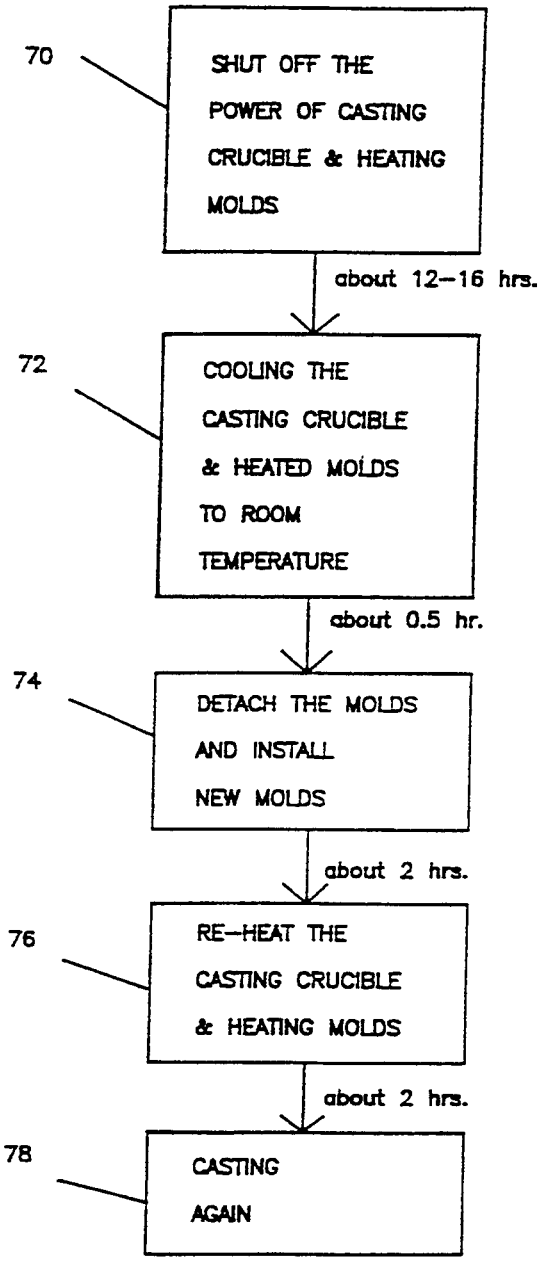
Fig. 1 (PRIOR ART)
FIG. 1 is a flow chart of a conventional mold changing procedure.
Figure 4:
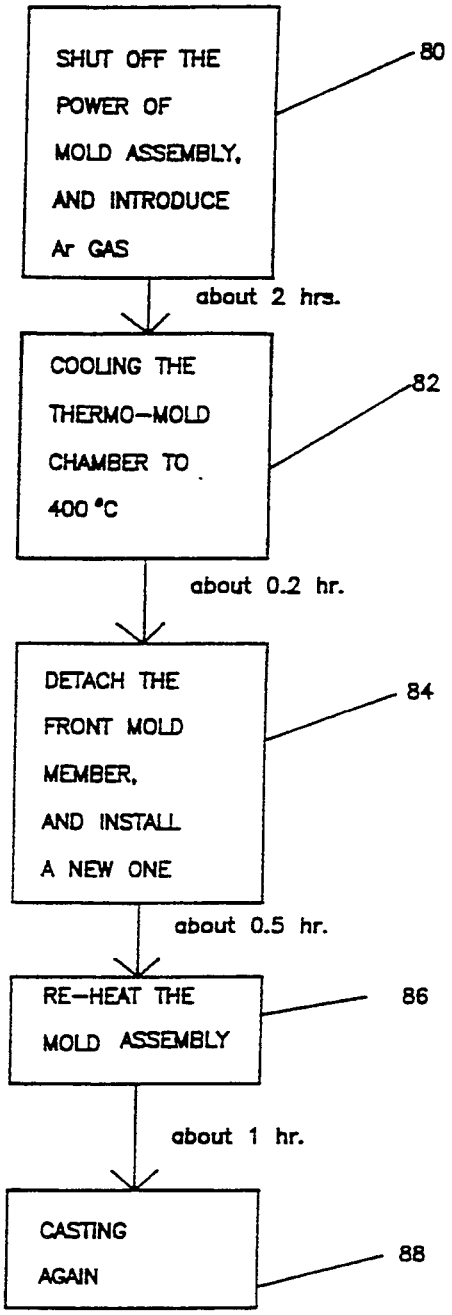
FIG. 4 is a flow chart of a mold changing procedure according to the present invention.
Figure 2:
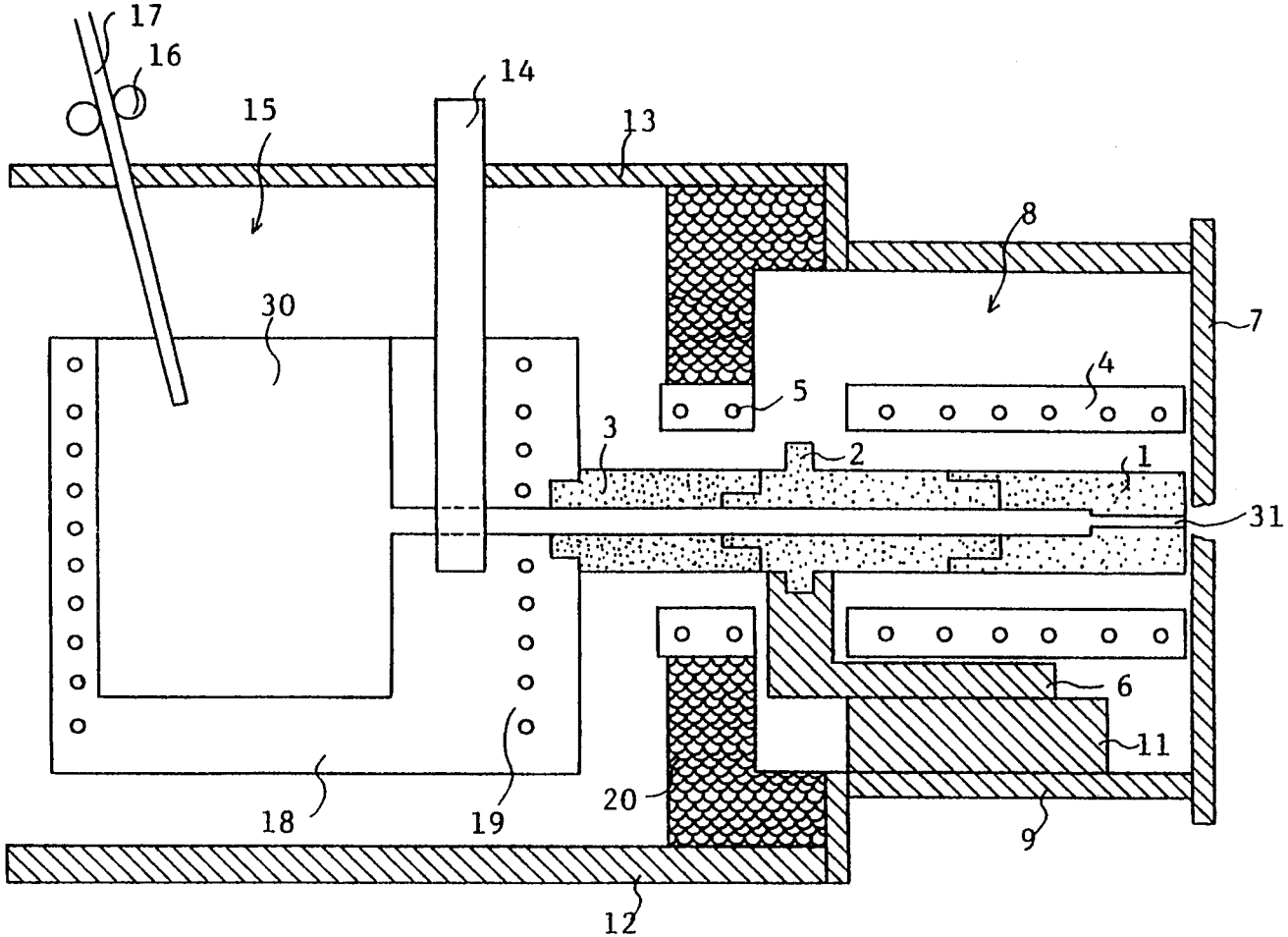
Fig. 2 (Prior Art)
FIG. 2 is a schematically sectional view of a conventional thermo-mold continuous casting apparatus.
Figure 3:
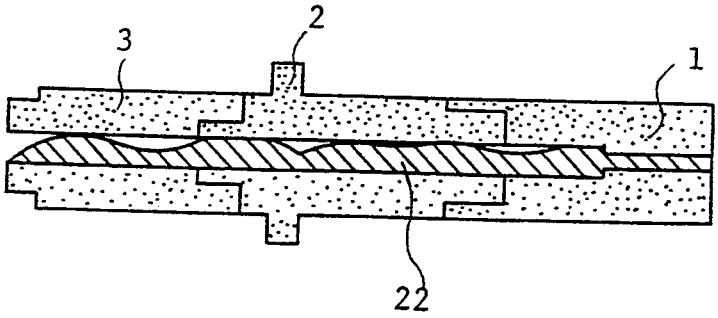
Fig. 3 (Prior Art)
FIG. 3 is a sectional view of a conventional mold assembly used in the apparatus shown for an apparatus in FIG. 2.
Figure 6:
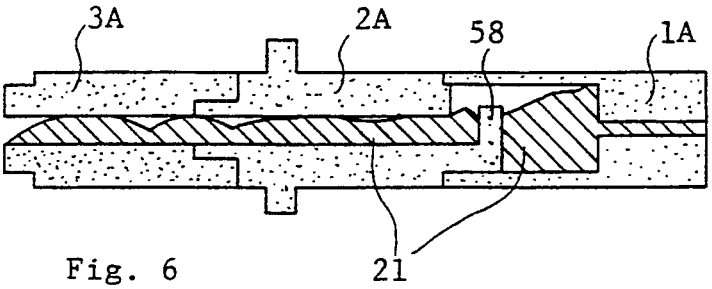
FIG. 6 is a sectional view of a mold assembly of the present invention used in an apparatus shown in FIG. 5.
Figure 5:
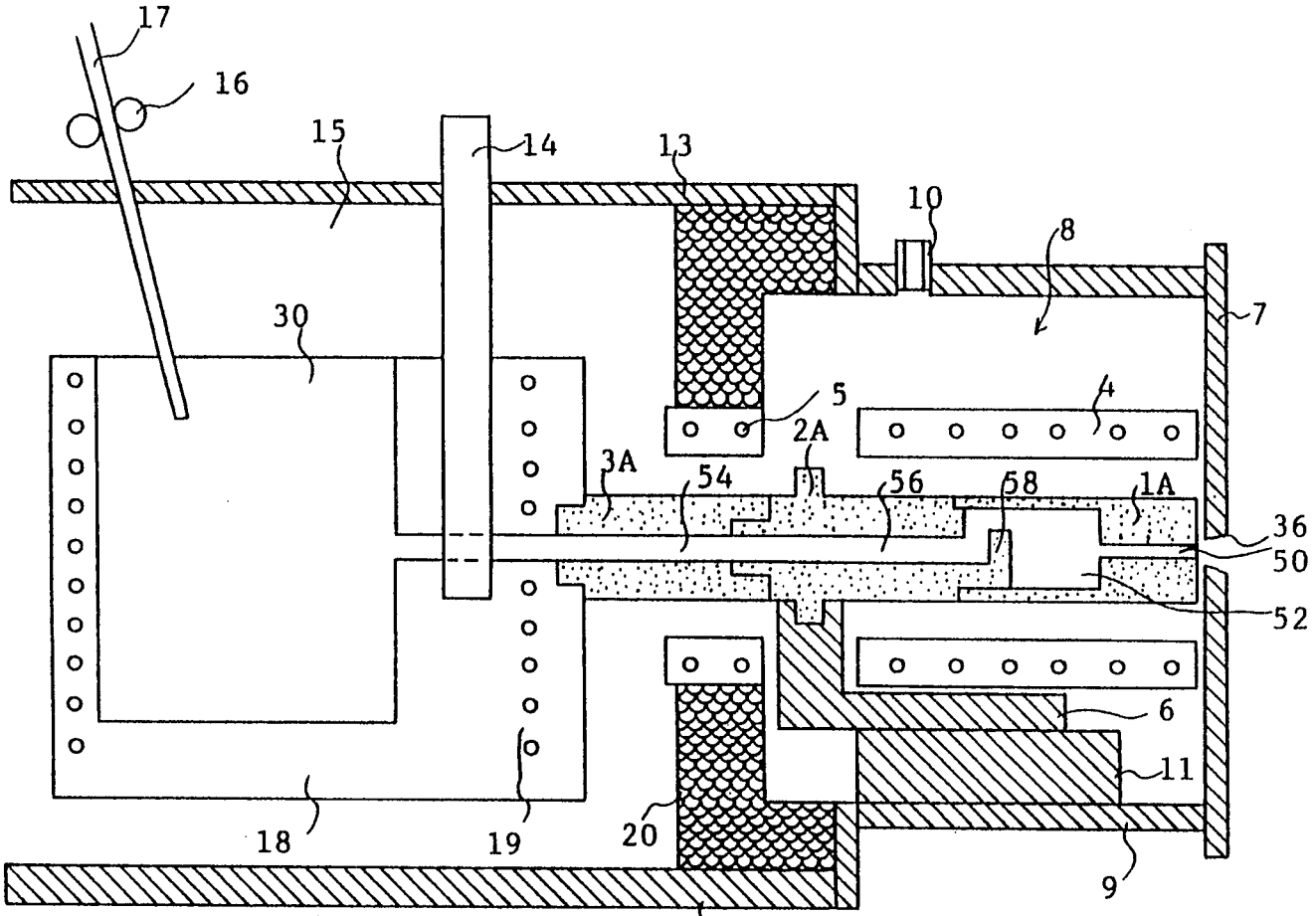
FIG. 5 is a schematically sectional view of a thermo-mold continuous casting apparatus according to one preferred embodiment of the present invention.

Referring now to FIGS. 4, 5 and 6, a fast mold changing system for a thermo-mold continuous casting according to one preferred embodiment of the present invention is mainly characterized in that the residual metal in its mold assembly will be separated into two parts automatically after being solidified. In this embodiment, the thermo-mold continuous casting apparatus is quite similar to that shown in FIG. 2, and the differences between them primarily include a different mold assembly (1A, 2A, and 3A) mounted in the thermo-mold chamber 8, and an air inlet 10 provided on the thermo-mold chamber 8, as shown in FIG. 5. For convenience, the corresponding elements in FIGS. 2 and 5 are designated by the same reference numbers.

Referring to FIGS. 5 and 6, the mold assembly of the present invention includes a front mold member 1A, a middle mold member 2A, and a rear mold member 3A. The front mold member 1A has two ends, one being positioned adjacent to the outlet 36 of the thermo-mold chamber 8 and provided with a casting cavity 50 therein, and the other being provided with an enlarged cavity 52 therein which communicates with the cavity 50. The cavity 50 extends from the enlarged cavity 52 substantially horizontally towards the outlet 36 of the chamber 8. The middle mold member 2A is connected to the other end of the front mold member 1A, and is provided with a cavity channel 56 therein which communicates with the enlarged cavity 52. In the cavity channel 56, the middle mold member 2A includes an upright stopper 58 which is such shaped that the cavity channel 56 has a first portion extending substantially horizontally from the left towards the right in the view of FIG. 5, a second portion vertically extending upwards from the first portion, and a third portion extending horizontally further from the second portion to communicate with the enlarged cavity 52 of the front mold member 1A. The upright stopper 58 will be used to separate the residual metals 21 (FIG. 6) in the front and middle mold members 1A and 2A when the casting process of the thermo-mold continuous casting apparatus is stopped in order to change the front mold member 1A. The rear mold member 3A is connected between the casting crucible 30 of the casting furnace 15 and the middle mold member 2A, and is provided with a cavity 54 communicating with the cavity channel 56 of the middle mold member 2A and the flow channel of the crucible 30.

When the mold changing is desired, the heaters 4 and 5 for the mold assembly are shut off, and thus the residual metal liquid in the mold assembly begins to be solidified along the direction from the cooler region, i.e. the region closer to the outlet 36 of the chamber 8, towards the rear mold member 3A. After being solidified, the residual metals in the enlarged cavity 52 and the cavity channel 56 will be separated automatically due to the contraction phenomenon caused by solidification, and gravity, as shown in FIG. 6. This allows the front mold member 1A be changed individually. To change the front mold member 1A, the cover 7 of the thermo-mold chamber 8 is first removed. Then, the front mold member 1A can be easily drawn out by any suitable tools, and a new front mold member can be re-installed in the thermo-mold chamber 8. In this way, the mold changing time is very short, and the operator's hands need not enter the thermo-mold chamber 8, so that the changing operations can begin once the temperature in the thermo-mold chamber 8 is lowered down to graphite's initial oxidization temperature, i.e. about 400° C.

The air inlet 10 on the thermo-mold chamber 8 is used to introduce a protective gas, for example an argon gas, into the thermo-mold chamber 8 during the changing procedure of the front mold member 1A. The introduced gas can accelerate the cooling speed of the chamber 8, and maintain a positive pressure within the chamber 8 to prevent the outer atmosphere from massively entering the thermo-mold chamber 8, so that the oxidization of the other mold members is avoided.

The mold changing procedure according to the embodiment of the present invention is summarized in FIG. 4. Firstly, the power of the mold assembly is shut off, and the argon (Ar) gas is introduced for about 2 hours, as shown in the block 80, in order to let the thermo-mold chamber 8 be cooled to about 400° C., as shown in the block 82. After about 0.2 hour, the front mold member 1A is detached, and a new one is installed, as shown in the block 84. This will take only about 0.5 hours. The mold assembly is re-heated for about 1 hour, as shown in the block 86, and then the casting process can begin again, as shown in the block 88. It can be seen that the mold changing time takes only about 4 hours. Comparing with the conventional mold changing time of about 18 hours mentioned above, the present invention is very timesaving. Also, the present invention can thus increase the yield, and save the energy and manpower.

Other advantages of the present invention are as follows:

1. Only the cavity design of the mold assembly needs to be modified, and an extra air inlet needs to be provided. Thus, the implementation of the present invention is simple, and its cost is not meaningfully increased.
2. In the entire mold changing operation, only the cover of the thermo-mold chamber is required to be opened. Such an operation is very simple, can save the manpower, and avoids mistakes which are frequently made in complicated operations of conventional mold changing procedure.
3. In casting, if the metal liquid overflows so severely that the outlet 36 of the thermo-mold chamber 8 is blocked, and that the cover 7 and the front mold member 1A are connected together, the cover 7 with the mold member 1A still can be easily detached from the thermo-mold chamber 8, according to the present invention.
4. The metal liquid in the casting crucible 30 can be kept at molten state during the changing operation of the front mold member 1A because the heater 19 is not turned off. Therefore, it is unnecessary to re-melt the metal after being solidified as in the prior art, so that the energy is saved. Also, several problems which generally occur in the remelting operation, such as the thermal expansion stress, are avoided.

While the invention has been described in terms of what are presently considered to be the most practical and preferred embodiments, it is to be understood that the invention needs not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A mold assembly in a thermo-mold continuous casting apparatus which has a casting furnace and a thermo-mold chamber provided with an outlet and is adapted to cast a metal comprising:

a first mold member adapted to be mounted within said thermo-mold chamber and having two ends one of which is adapted to be positioned adjacent to said outlet and provided with a first cavity therein and the other of which is provided with a second cavity therein communicating with said first cavity in said one end; and a second mold member adapted to be mounted within said thermo-mold chamber, connected to said the other end, and being provided with a cavity channel therein communicating with said second cavity, characterized in that said mold assembly further includes means for separating a residual metal in said first and second mold members when a casting procedure in said thermo-mold continuous casting apparatus is stopped.

2. A mold assembly according to claim 1 wherein said second cavity is larger than said first cavity and said cavity channel in diameter.

3. A mold assembly according to claim 1 wherein said separating means is provided in said cavity channel.

4. A mold assembly as claimed in claim 3, wherein said separating means is a substantially upright stopper in said cavity channel.

5. A mold assembly as claimed in claim 4, wherein said cavity channel has a first portion extending substantially horizontally, a second portion extending upwards from said first portion, and a third portion extending substantially horizontally from said second portion and communicating with said second cavity of said first mold member.

6. A mold assembly as claimed in claim 1, wherein said first cavity extends substantially horizontally.

7. The mold assembly as claimed in claim 1, further comprising a third mold member adapted to be mounted within said thermo-mold chamber, connected between said casting furnace and said second mold member, and being provided with a third cavity communicating with said cavity channel.

8. A mold assembly according to claim 1 wherein said first mold member is replaceably mounted within said thermo-mold chamber.

9. A mold assembly as claimed in claim 8, further comprising an air inlet mounted on said thermo-mold chamber, and adapted to introduce therethrough a protective gas into said thermo-mold chamber upon replacing said first mold member.

10. A mold assembly as claimed in claim 9, wherein said protective gas is an argon gas.

* * * * *